US006113417A

United States Patent [19]

Furutani et al.

[11] Patent Number: 6,113,417

[45] Date of Patent: Sep. 5, 2000

[54] TERMINAL FITTING

[75] Inventors: Mitsugu Furutani; Keigo Atsumi; Masahiko Aoyama; Hitoshi Okumura, all of Yokkaichi, Japan

[73] Assignee: Sumitomo Wiring Systems, Ltd., Japan

[21] Appl. No.: 08/982,443

[22] Filed: Dec. 2, 1997

[30] Foreign Application Priority Data

Dec. 2, 1996 [JP] Japan ..... 8-321877

[51] Int. Cl.[7] ..... H01R 4/24

[52] U.S. Cl. ..... 439/397; 439/400

[58] Field of Search ..... 435/387, 389, 435/391, 393, 395, 396, 397–9, 400, 401–7

[56] References Cited

U.S. PATENT DOCUMENTS 5,014,535 5/1991 Marpoe, Jr. et al. .
5,073,126 12/1991 Kiluchi et al. ..... 439/452
5,133,672 7/1992 Nelligan, Jr. et al. .
5,139,434 8/1992 Goodman .
5,549,483 8/1996 Hotea ..... 439/399
5,588,868 12/1996 Tsuji et al. .
5,591,044 1/1997 Abe et al. .

FOREIGN PATENT DOCUMENTS 2028600 3/1980 United Kingdom .
WO 86/06552 11/1986 WIPO .

*Primary Examiner*—Lincoln Donovan
*Attorney, Agent, or Firm*—Banner & Witcoff, Ltd.

[57] ABSTRACT

To increase the accuracy of the slot dimension of a pressure contact terminal fitting, a pair of anteriorly and posteriorly located pressure contact blades 22 and 23, engage protrusions 26 and 27 formed in the terminal base. The position of the blades 22 and 23 is thus maintained against deformation loads.

4 Claims, 3 Drawing Sheets

TERMINAL FITTING

TECHNICAL FIELD

The present invention relates to a so-called pressure contact type terminal fitting wherein pressure contact is made with an electric wire.

BACKGROUND TO THE INVENTION

FIG. 5 of this specification shows a common pressure contact type terminal fitting. The fitting shown in FIG. 5 is female. Its anterior end has a connecting member 71 into which a corresponding terminal fitting is inserted. Its posterior end has a pressure contact member 72 which is electrically connected with a core of an electric wire by cutting through the covered portion of the wire, and barrels 73 for clamping the covered portion of the wire. The pressure contact member 72 has towards its anterior and posterior ends two pairs of pressure contact blades 75 which are formed so as to mutually face each other by being part-sheared out from left and right side walls 74. When an electric wire is inserted into a pressure contact groove 76 formed between the pressure contact blades 75, each pressure contact blade 75 cuts into the covered portion of the wire and makes electrical contact with the core.

The width of the pressure contact grooves 76 poses a problem when pressure contact is made with the electric wire. That is, if the pressure contact groove is too wide, the pressure contact blades cannot make a good mechanical contact with the core, resulting in poor electrical contact. If, on the other hand, the width is too narrow, the pressure contact blades can cut through the core wire. For this reason, improving the accuracy of the width of the pressure contact groove is an extremely important issue.

The pressure contact groove in the terminal fitting shown in FIG. 5 is formed by part-shearing, and due to the angle of shearing, an accurate width of the groove is difficult to obtain. For this reason, the accuracy of the width of the pressure contact groove frequently presents a problem. In particular, the springing back of the pressure contact blades adversely affects the width.

The present invention has been developed after taking the above problems into consideration, and aims to provide an accurate dimension of width of a pressure contact groove in a terminal fitting of the type wherein pressure contact blades are cut out from side walls so as to face each other.

SUMMARY OF THE INVENTION

According to a first aspect the invention provides an electrical terminal fitting having a channel to receive an insulated electric wire, the channel have blades directed inwardly to define a wire receiving slot, characterised in that the base of said channel includes restraining means for retaining a blade against displacement axially of the channel.

Such restraining means may be provided by co-operating projections and/or recesses of the blades and base, and serve to hold the blades of a terminal in the desired position against spring back and external loads.

The restraining means preferably abut the blades, and the terminals can thus be bent from sheet material.

In one embodiment the restraining means comprise indentations of the base; such indentations avoid apertures which may weaken the base.

Blades of such a terminal may wrap around projections part-sheared and bent out of the base. Alternatively a blade may be formed with a projection to engage a recess of the base.

According to a second aspect, the invention provides a method of forming an electrical terminal from electrically conductive sheet material, the terminal having inwardly directed blades to define a wire receiving slot, the method comprising three interchangeable steps of a) stamping a blank from sheet material, the blank having a base portion and two side wall portions;

b) part-shearing said blades from said side wall portions, and bending said blades substantially at right angles to the plane of said blank;

c) forming restraining means in said base portion; and a final step of d) bending said side walls substantially at right angles to the plane of said blank, thereby to engage said blades in respective restraining means.

BRIEF DESCRIPTION OF DRAWINGS

Other features of the invention will be apparent from the following description of several preferred embodiments shown by way of example only in the accompanying drawings in which.

DESCRIPTION OF PREFERRED EMBODIMENTS

Figure 1:
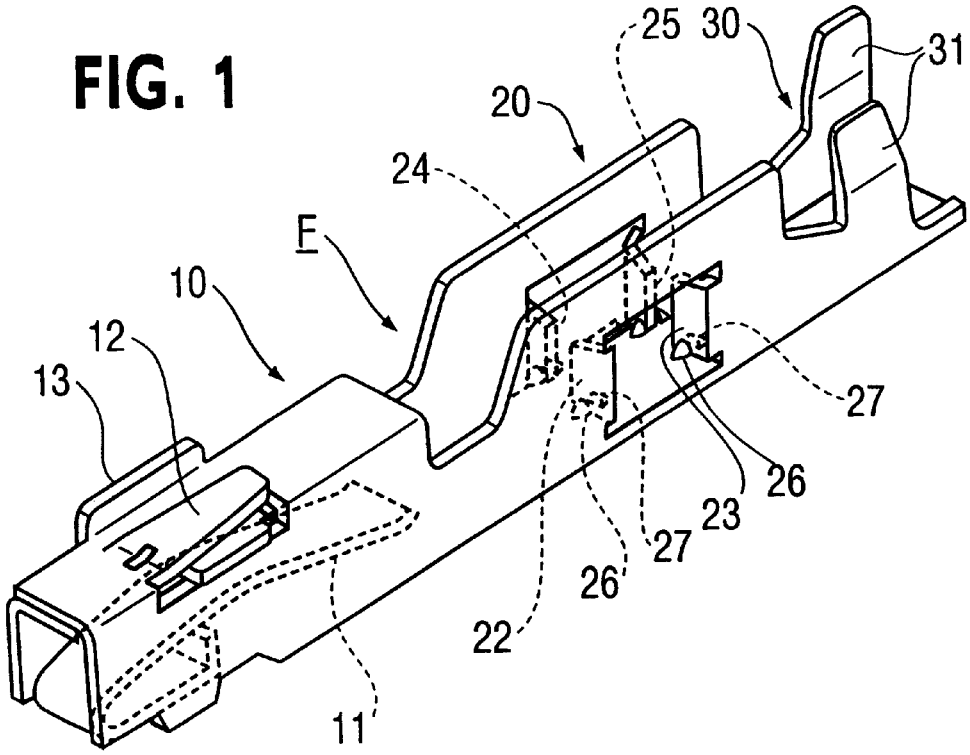
FIG. 1 is a diagonal view of the first embodiment of the invention.
Figure 2:
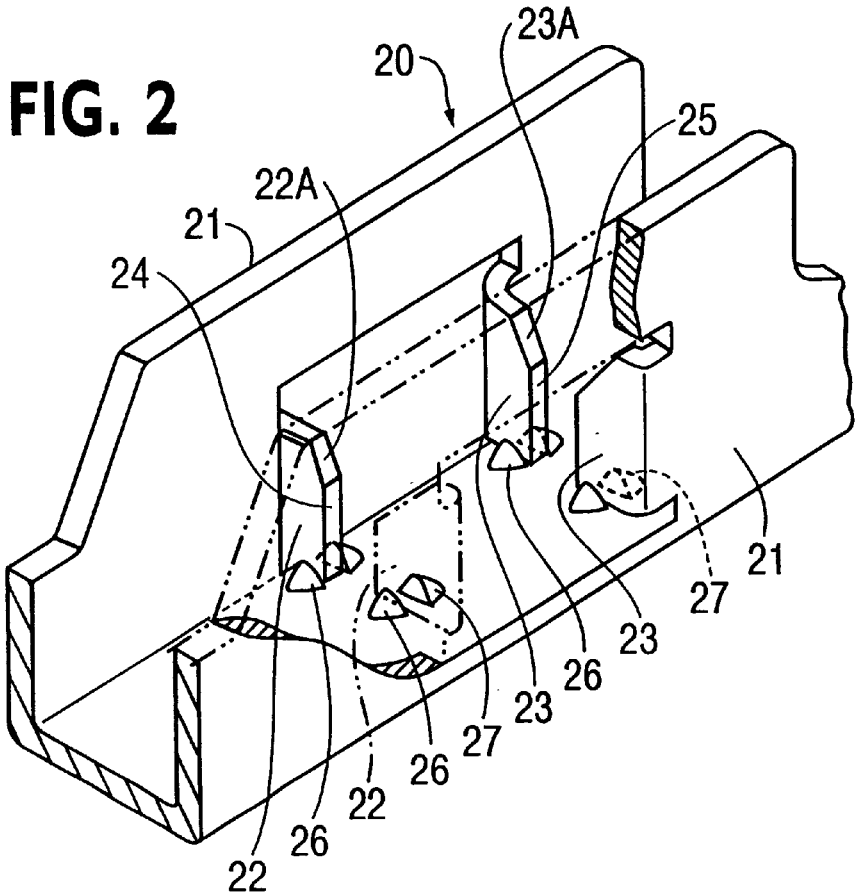
FIG. 2 is a partially cut-away diagonal view showing a pressure contact member of the first embodiment.

A first embodiment of the present invention is explained hereinbelow, with reference to FIGS. 1 and 2.

A female terminal fitting F is configured by bending an electrically conductive sheet metal. As shown in FIG. 1, the anterior portion of the female terminal fitting F has a connecting member 10 for inserting a corresponding terminal fitting (not shown) and its posterior end has a pressure contact member 20 for making pressure contact with an electric wire, and barrels 30 for crimping over the covered portion of the electric wire.

The connecting member 10 has a box shape and its anterior face is open. In its interior, a resilient contact member 11 is formed by folding in an anterior edge thereof. The resilient contact member 11 makes contact with the corresponding terminal fitting. The upper face of the connecting member 10 has a lance 12 that fits with a housing (not shown) and thereby makes the female terminal fitting F unremovable, and a stabilizer 13 that guides the insertion of the female terminal fitting F into the housing.

A pressure contact member 20 connects with the posterior end of the connecting member 10, and is shaped so that its upper face forms an open channel. As shown in FIG. 2, left and right side walls 21 have a pair of pressure contact blades 22 located at the anterior end and cut out so as to face inwards towards each other, and a pair of pressure contact blades 23 located at the posterior end and cut out so as to face inwards towards each other. The blades 22 and 23 define pressure contact grooves 24 and 25. When an electric wire is inserted into the grooves 24 and 25, each blades 22 and 23 cuts into the covered portion of the electric wire and makes contact with the core. The upper edges of the facing sides of the pressure contact blades 22 and 23 are cut away diagonally, thereby forming guiding members 22A and 23A for guiding the wire into the grooves 24 and 25.

Each blade 22 and 23 is approximately at a right angle with respect to the side walls 21. Restraining protrusions 26 and 27 are pressed out from the base face so as to restrain, from front and behind, the blades 22 and 23.

Barrels 30 connect with the posterior end of the pressure contact member 20, and have barrel members 31 that protrude upwards from the left and right sides. The electric wire can be fixed to the female terminal fitting F by clamping it with the barrel members 31 in a conventional manner. Each barrel member 31 is slightly displaced with respect to the other in an anterior-posterior direction, and in the clamped state each barrel member 31 prevents the electric wire from lifting up. In other words, each barrel member 31 is staggered.

The sequence of assembly of the pressure contact member 20 is discussed below. First, before bending the pressure contact member 20, each pressure contact blade 22 and 23 is part-sheared and bent at approximately a right angle to the side walls 21. Then, the left and right side walls 21 are bent up at a right angle. When this is done, the lower edge of each pressure contact blade 22 and 23 is inserted between the restraining protrusions 26 and 27, and prevented from moving back and forth. Consequently, a change of shape or position of the blades is prevented.

In this way, in the present embodiment, the pressure contact blades 22 and 23 are maintained in the cut-out position, and there is no possibility of their springing back. Accordingly, the width of the pressure contact grooves 24 and 25 is substantially fixed, and the accuracy of dimension thereof can be increased. Furthermore, a change in shape due to an external force, etc., can be resisted. Moreover, in the present embodiment, since the restraining protrusions are formed by being pressed in, no opening need he formed on the base face, thereby preventing a reduction in the strength thereof.

Figure 3:
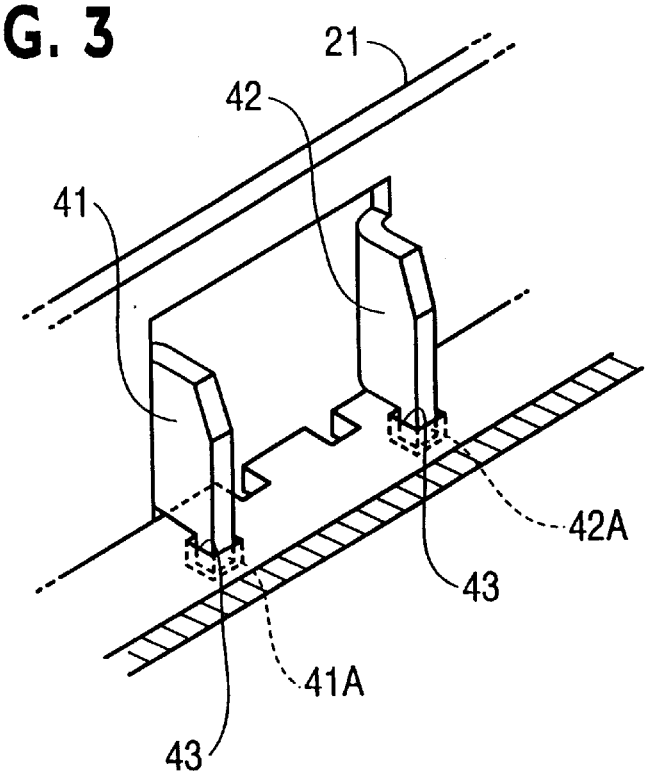
FIG. 3 is a partially cut-away diagonal view showing a pressure contact member of a second embodiment.

A second embodiment of the present invention is explained with the aid of FIG. 3.

The present embodiment differs from the first embodiment with respect to the configuration of the restraining means. Since the configuration of the other parts is the same as in the first embodiment, the same numbers are accorded to parts having the same configuration as in the first embodiment, and an explanation thereof omitted.

In the second embodiment, the lower edges of the inner sides of cut out pressure contact blades 41 and 42 protrude downwards, and restraining protrusions 41A and 42A are formed thereon. A base face has restraining holes 43 for allowing the insertion of the restraining protrusions 41A and 42A. When each side wall is bent at a right angle, the restraining protrusions 41A and 42A are engaged in the restraining holes 43.

Each pressure contact blade 41 and 42 is thus maintained at a right angle. Consequently, the blades 41 and 42 cannot spring back, and the accuracy of the width-wise dimension of pressure contact grooves can be increased.

Figure 4:
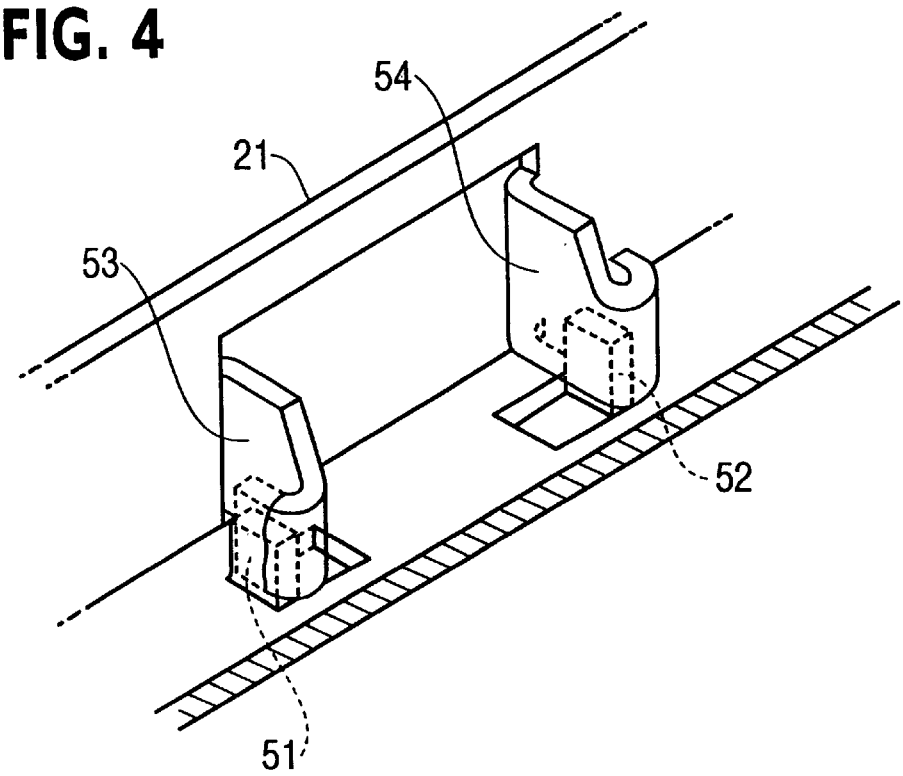
FIG. 4 is a partially cut-away diagonal view showing a pressure contact member of a third embodiment.
Figure 5:
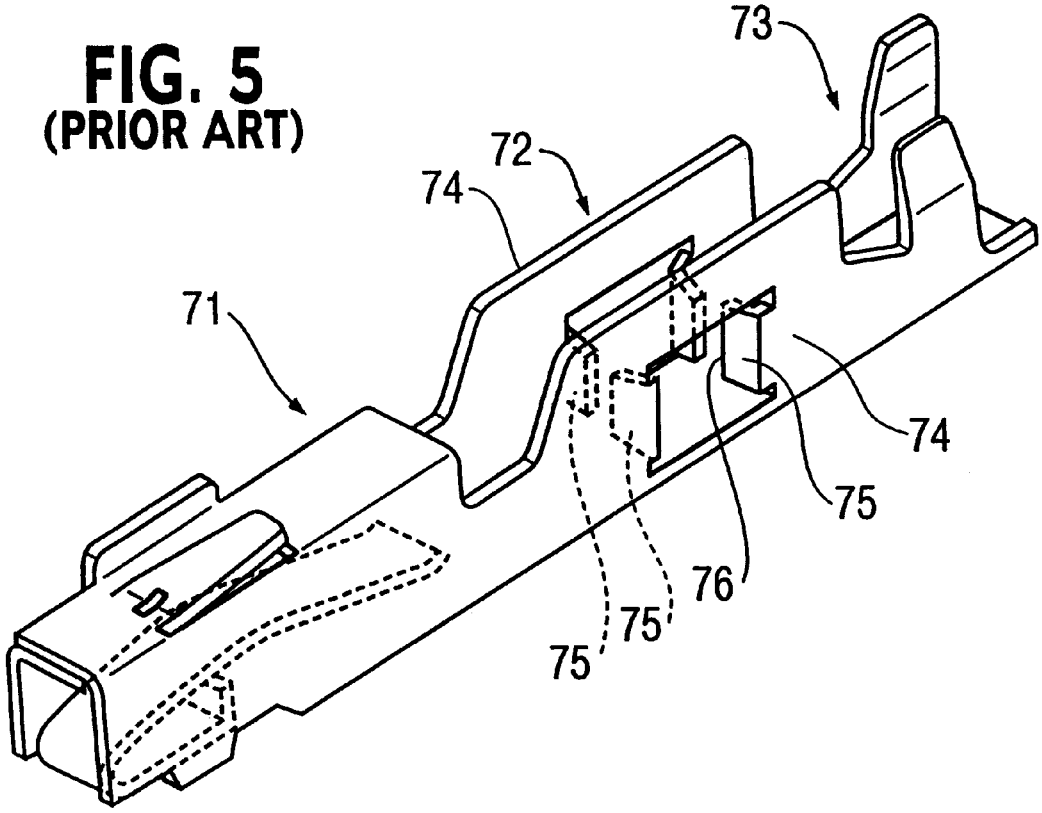
FIG. 5 (PRIOR ART)
FIG. 5 is a diagonal view of a first prior art terminal fitting.

A third embodiment of the present invention is explained with the aid of FIG. 4.

The present embodiment differs from the first embodiment with respect to the configuration of the restraining means. Since the configuration of the other parts is the same as in the first embodiment, the same numbers are accorded to parts having the same configuration as in the first embodiment, and an explanation thereof omitted.

In the third embodiment, a base face has restraining members 51 part-sheared from an anterior end thereof, and restraining members 52 part-sheared from a posterior end thereof. Then, as in the case of the first embodiment, pressure contact blades 53 and 54 are part-sheared side walls 21, and the ends thereof are bent and folded over the restraining members 51,52, the bending and folding over being carried out so that the pressure contact blades 53 and 54 respectively press against the restraining members 51 and 52.

Thus, the blades 53 and 54 can be maintained in position, and the accuracy of the pressure contact grooves is maintained.

The present invention is not limited to the embodiments described above. For example, the possibilities described below also lie within the technical range of the present invention.

(1) In the above embodiments, the invention was applied to a female terminal fitting, but it may equally be applied to a male terminal fitting.

(2) Although in the first embodiment the restraining members 26 and 27 are located in front of and behind the pressure contact blades 22 and 23, it may equally be arranged so that they are only on a side opposing the spring back or pulling forces.

(3) In the above embodiments, the pressure contact member comprises two pairs of anteriorly and posteriorly located pressure contact blades 22,23,41,42,53 and 54. However, it may equally be arranged so that there is only one anteriorly located pair, or only one posteriorly located pair, or three or more pairs of pressure contact blades.

In addition, the present invention may be embodied in various other ways without deviating from the scope of the claims thereof.

We claim:

1. An electrical terminal fitting having a channel defined by a pair of sidewalls and a base to receive an insulated electrical wire, the channel having blades directed inwardly from the side walls to define a wire receiving slot, wherein the base of said channel includes restraining means which contact lower ends of said blades to prevent axial displacement of the blades in the channel the restraining means includes at least one abutment for each for each said blade, and each said abutment includes an upstanding projection from said base.

2. A fitting according to claim 1 wherein each said projection comprises an upward indentation in said base.

3. A fitting according to claim 1 wherein each said projection is part-sheared out of said base to be inwardly offset from the base but not removed therefrom.

4. A fitting according to claim 3 wherein each said blade wraps around one of said projections.

* * * * *

UNITED STATES PATENT AND TRADEMARK OFFICE

CERTIFICATE OF CORRECTION

PATENT NO.: 6,113,417

DATED: September 5, 2000

INVENTORS: Mitsugu FURUTANI, *et al.*

It is certified that errors appear in the above-identified patent and that said Letters Patent is hereby corrected as shown below:

In Claim 1, Column 4, Line 51, immediately after "channel", --,-- has been inserted; and Line 52, "for each" (second occurrence) has been deleted.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*